US005704683A

United States Patent [19]

Cooper et al.

[11] Patent Number: 5,704,683

[45] Date of Patent: Jan. 6, 1998

[54] MULTI-PURPOSE CONVERTIBLE FURNITURE

[76] Inventors: Robert James Cooper, Sylvia Thomas Apartments, Rambury's Site, St. Kitt's/Nevis, St. Kitts/Nevis; Laszlo Szantor, Apartment 17, 129 Pine Street, Pictou, Nova Scotia, Canada, B0K 1H0

[21] Appl. No.: 693,180

[22] PCT Filed: Feb. 14, 1995

[86] PCT No.: PCT/CA95/00069

§ 371 Date: Aug. 14, 1996

§ 102(e) Date: Aug. 14, 1996

[87] PCT Pub. No.: WO95/21558

PCT Pub. Date: Aug. 17, 1995

[30] Foreign Application Priority Data

Feb. 15, 1994 [CA] Canada ..... 2115685

[51] Int. Cl.[6] ..... A47B 85/04

[52] U.S. Cl. ..... 297/124; 297/126

[58] Field of Search ..... 108/11, 17, 64, 108/157; 297/124

[56] References Cited

U.S. PATENT DOCUMENTS

| | | | |
|---|---|---|---|
| 265,787 | 4/1882 | Berquist . | |
| 1,757,960 | 5/1930 | Greenstreet | 297/124 |
| 2,561,703 | 7/1951 | Koenig . | |
| 2,897,876 | 8/1959 | Austin | 297/124 |
| 2,959,209 | 11/1960 | Lakin | 297/124 |
| 3,061,369 | 10/1962 | Haunost . | |
| 3,212,606 | 10/1965 | Spaw . | |
| 3,361,470 | 1/1968 | Gustin . | |
| 3,420,571 | 1/1969 | Moore . | |
| 3,809,183 | 5/1974 | Lowd et al. . | |
| 4,008,786 | 2/1977 | Canavan . | |
| 4,248,326 | 2/1981 | Hansen et al. . | |
| 4,801,175 | 1/1989 | Albanese . | |
| 4,913,488 | 4/1990 | Donnell . | |

FOREIGN PATENT DOCUMENTS

| | | |
|---|---|---|
| 547713 | 10/1957 | Canada . |
| 821286 | 8/1969 | Canada . |
| 1305916 | 8/1992 | Canada . |

*Primary Examiner*—Peter M. Cuomo
*Assistant Examiner*—Gerald A. Anderson
*Attorney, Agent, or Firm*—Woodward, Emhardt, Naughton, Moriarty & McNett

[57] ABSTRACT

A convertible furniture article (1) can be configured alternatively to provide a bench-type seat, a picnic table or work bench, or a platform or staging. The article has a rigid base frame (2) which supports a seat (4) and a movable top structure that can serve as a table top (3), a platform, or a back rest associated with the seat. Two such articles can be juxtaposed in confronting relation to provide a picnic table. The article can be designed to provide seating for one or more individuals according to its size, and can also serve as a work bench or a desk with an adjustably inclinable top surface.

24 Claims, 4 Drawing Sheets

MULTI-PURPOSE CONVERTIBLE FURNITURE

BACKGROUND OF THE INVENTION a) Field of the Invention

This invention relates to a new or improved multi-purpose convertible furniture article and in particular to an article that can provide, amongst other uses, a bench-type seat, or a combined table and seat, in the latter configuration the article also being usable as an elevated platform or staging.

b) Description of the Prior Art

Convertible picnic-type tables have previously been proposed in various forms, to provide articles that can be used as tables or benches, sawhorses, scaffolding or other supports, and examples of such articles can be seen in U.S. Design Pat. No. D-265,787 and also in U.S. Pat. No. 1,792,737 Greenstreet, U.S. Pat. No. 4,606,575 Kodet and U.S. Pat. No. 4,615,559 Blondeau. U.S. Pat. No. 4,801,175 Albanese shows an example of a furniture article that provides a convertible bench/table. However the Albanese structure is not useful as a support platform since it does not provide a sufficiently stable support for the table top when in the horizontal position. U.S. Pat. No. 4,913,488 Donnell JR. shows another example of convertible furniture which has a support member rotatably mounted on the frame and movable from a seat back position to a table top position. However in the table top position Donnell's support member is clearly unsuitable for use as a support platform since is only supported over a relatively narrow portion in the front to back direction nor would it provide the desired degree of stability for use as a support platform. It is believed that few of the prior art designs have been commercially successful, one possible reason being that they are inadequately designed or unduly complicated so as not to be economically viable. Such prior art designs of convertible bench/tables furthermore lacked stability in the table configuration.

SUMMARY OF THE INVENTION

The aim of the present invention is to provide a multi-purpose convertible furniture article that is of sturdy and relatively simple construction and that will, in particular, be stable when used in a table or platform configuration.

Accordingly the invention provides an article of furniture comprising: a substantially rigid base frame having four feet regularly arranged in longitudinally aligned front and rear pairs which pairs are spaced transversely from each other to provide a stable support for said article upon a horizontal surface; said frame including longitudinally spaced sub-frames extending transversely and from top-to-bottom of said frame, said sub-frames being rigidly interconnected by vertically and transversely spaced horizontally extending frame elements and by brace means; two of said frame elements comprising a pair of longitudinally spaced horizontal supports each rigidly attached at transversely spaced locations on said frame and having end portions projecting transversely beyond a rear side of said frame; a horizontal seat carried on and extending between said end portions; said article further including a table top that is selectively movable between a horizontal position wherein it is supported on a top section of said frame, and a lower position wherein it is supported on said frame in a position extending upwardly from one longitudinal edge of said seat so as to provide a backrest, guide means interacting between said table top and said frame to accommodate such movement of the table top; retainer means selectively operable to secure said table top in said horizontal position wherein it is transversely offset relative to said seat.

The furniture article can be made of any suitable material, but conveniently can be fabricated substantially entirely from wood. Without requiring the furniture article to be excessively weighty, it can be configured to provide the required stability when used as a platform or staging by arranging the front feet to be positioned more or less directly below the front edge of the table top. Similarly the rear feet are positioned directly below or not far forwardly of the rear edge of the seat so that the furniture article will not lose its stability even when the user's weight is concentrated on the rear edge of the seat.

For convenience in moving the article, one or other of the pair of feet (preferably the rear pair) may include wheels so that the furniture article can be lifted at the side opposite where the wheels are located and readily transported by being rolled on the wheels.

The guide means for the table top is preferably provided by an elongate slot formed in a stringer that extends across the width of the underside of the table top in the front to rear direction, each of these slots cooperating with a respective pin in the adjacent end of the base frame in the upper rear area thereof. In the horizontal position of the table top the pin is received in one end of the slot so that the table top can be moved transversely and pivoted into the bench backrest position.

Preferably at each end of the table there is a retaining pin that, when the table top is in its horizontal position can be inserted through the forwardmost end of the slot and engaged in a socket in the adjacent upper front portion of the base frame to secure the table top against rearward or pivotal movement. It may be desirable to arrange for the entire weight of the table top and any load supported thereon to be transmitted to the base frame through the pivot pins and the retaining pins.

It is also desirable to include adjustable support means through which the table top can be supported at various inclined positions. Such support means could be in the form of a pivoted link at each end of the table top having a series of holes therein enabling the retaining pin to be passed through a selected hole to engage in the base frame socket, so that the pivoted link then supports the table top at the desired angle of inclination.

As referred to above, the convertible furniture article can be configured so that it forms a bench or a table, and can also be utilized as a support platform, a sawhorse, a combination work bench, a desk, and indeed for many other purposes as will occur to the user. If desired, it can be designed to be collapsible so that it can be disassembled for shipping or storage.

BRIEF DESCRIPTION OF THE DRAWINGS

Numerous features and details of the invention will be more fully understand from the following description of specific embodiments, given by way of example only, when read in conjunction with the accompanying drawings wherein.

DESCRIPTION OF THE PREFERRED EMBODIMENTS

Figure 1:
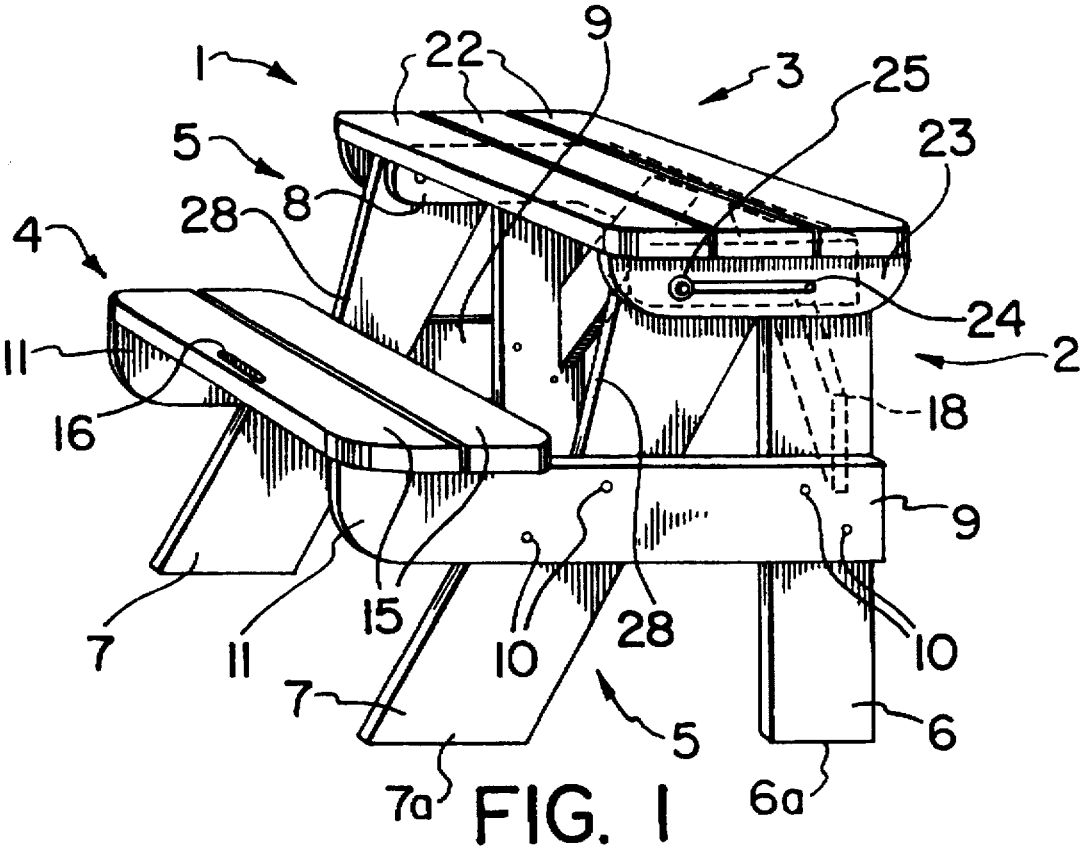
FIG. 1 is a perspective view, from the rear and one end, of a preferred embodiment of the convertible furniture article.

The furniture article 1 comprises a sturdy and rigid base frame 2 on which is supported a table top 3, and a longitudinally extending seat 4 that projects rearwardly from the frame.

The frame may be fabricated of any desired material and as shown in the drawings comprises two vertically oriented longitudinally spaced sub-frames 5 which are rigidly interconnected to form the base frame. Each sub-frame 5 is of generally A-shape as seen in side view comprising a generally upright front leg 6 and an upwardly and forwardly inclined rear leg 7, these legs being interconnected by a transverse horizontal top member 8 near their upper ends and at about mid-height by a transverse horizontally extending intermediate member 9, the members 8 and 9 extending in what for convenience is herein described as the front to rear direction of the article. The members 8 and 9 are rigidly interconnected to the legs 6 and 7 by suitable fastening means, as illustrated by bolts 10.

Each intermediate horizontal member 9 projects rearwardly of the leg 7 and carries one end of a seat 4 formed as shown by two timber planks 15 attached as by nailing to the extensions 11, the outermost plank 15 having centrally therein a hand grip aperture 16.

Figure 2:
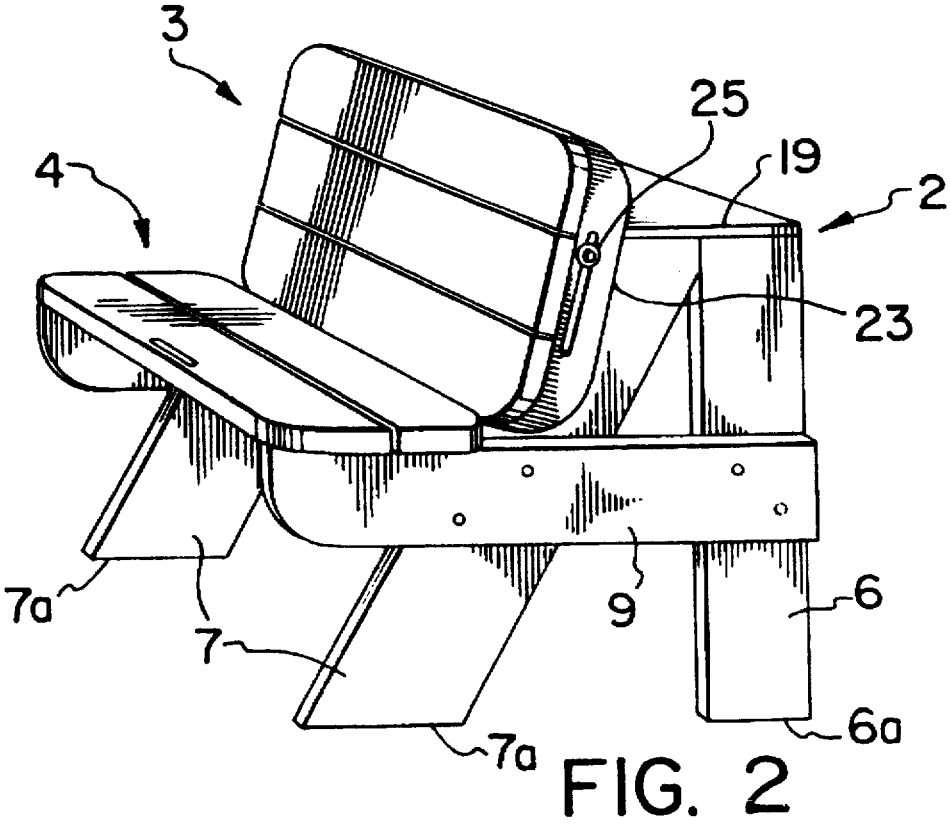
FIG. 2 is a perspective view corresponding to FIG. 1 showing the furniture article in a modified configuration as seen in FIG. 6.
Figure 3:
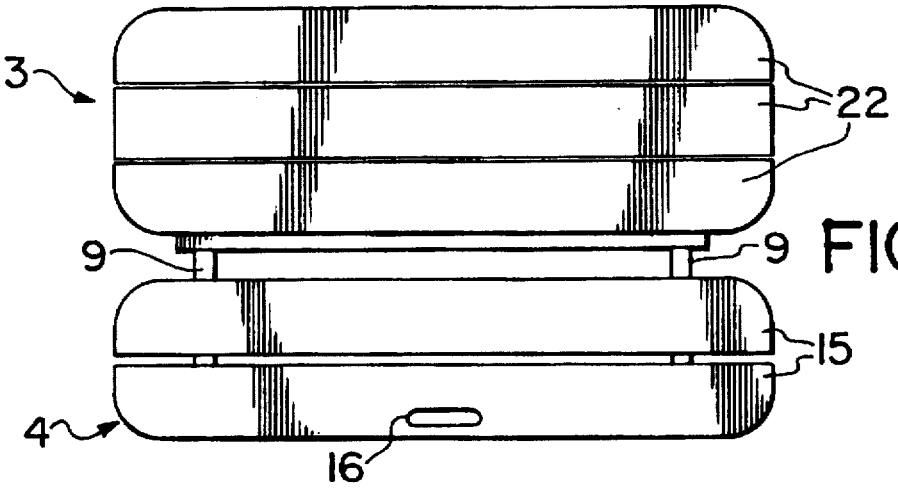
FIG. 3 is a plan view.
Figure 4:
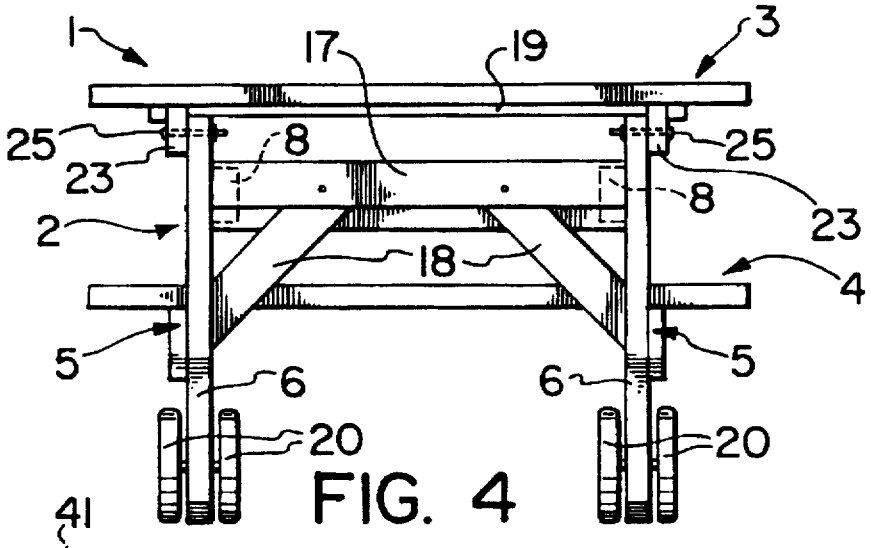
FIG. 4 is a front elevational view of a second embodiment, that is modified by the inclusion of wheels at the lower end of the front legs.

As best seen in FIG. 4, the end sub-frames 5 are rigidly interconnected by a longitudinally extending member 17 spaced below the upper ends of the sub-frames, this being secured to the front legs 6 and reinforced by angularly arranged braces 18. The top ends of the sub-frames 5 are further interconnected by longitudinally extending wooden planks 19 screwed to the tops of the legs 6 and 7. In the embodiment of FIGS. 1 and 2 the lower ends of the legs provide widely spaced feet 6*a*, 7*a* whereas in the embodiment of FIGS. 4 to 8 the feet at the lower ends of the front legs 6 are coaxial pairs of wheels 20.

The table top 3 comprises a number of longitudinally extending wooden planks 22 extending in closely spaced relationship and interconnected on their undersides at each end on the outboard side of the adjacent sub-frame 5 by a transverse stringer 23 extending as seen in FIG. 1 in the front to rear direction, the stringers being wooden members to which the planks 22 are nailed to provide therewith a rigid table top structure which has a transverse width in the front to rear direction (see FIG. 4) that only slightly exceeds the width of the top end of the base frame 2. Each stringer 23 has a longitudinal through slot 24 therein, this slot having a length that is only slightly less than the length of the stringer. A pivot pin 25 mounted in the upper rear corner of each sub-frame 5 projects laterally therefrom and extends through the slot 24 in the adjacent stringer, the pins 25 being coaxial and together forming a pivot axis for the table top.

Figure 9:
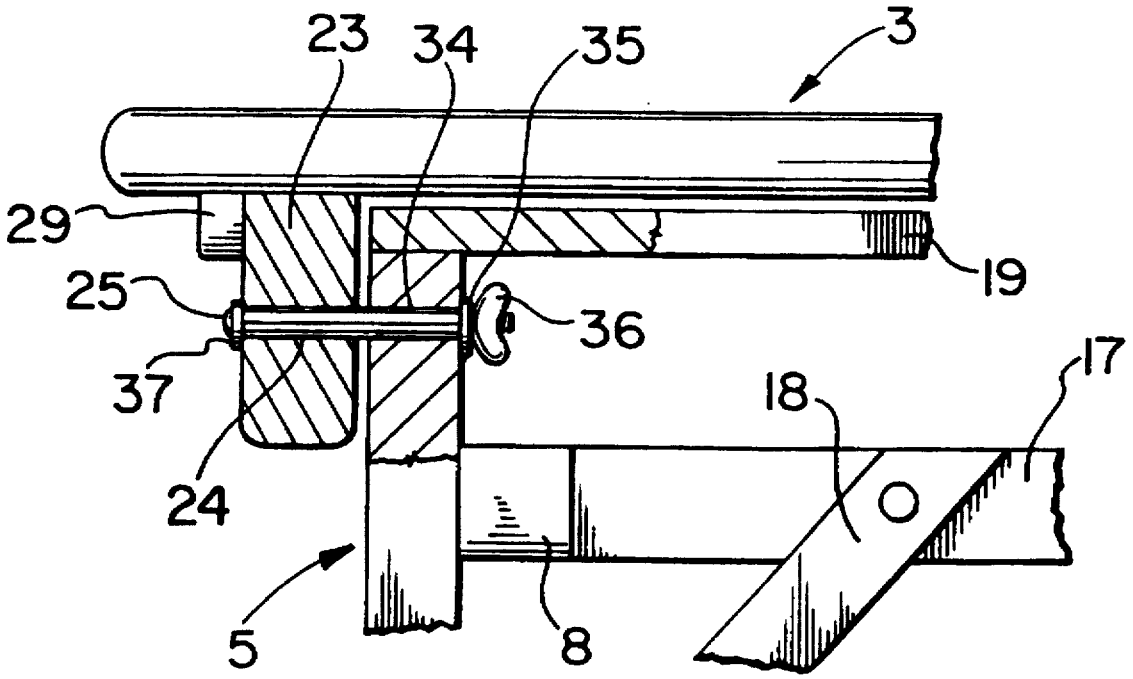
FIG. 9 is an enlarged fragmentary front elevational view showing a portion of the article as seen in FIG. 4.

Horizontally offset from the pivot pin 25, each sub-frame 5 has a socket 26 (FIG. 6) which is aligned with the front end of the respective slot 24 and which receives a retaining pin 27 which can be passed from the outboard side through the front end of the slot. It will be seen that with the retaining pin positioned in its socket as illustrated in FIG. 4, the table top is essentially immobilized. In this position, as shown in FIG. 9, the planks 22 of the table top are spaced slightly above the horizontal planks 19 on top of the sub-frame, and accordingly the weight of the table top and of any load supported thereon is transmitted to the base frame through the pivot pins 25 and retaining pins 27. Thus the pins 25 and 27 provide a solid abutment supporting the table top in its horizontal position and do not rely on any frictional force in this supporting action. Additionally, the planks of the table top have only a small clearance above the planks 19 at the top of the base frame (see particularly FIGS. 9 and 10) and so can provide additional support to the table top in the event that it deflects downwardly in the middle under load. Additionally, the rigid base frame 2 provides a safety feature in that in the event of failure of one or more of the pins 25 and 27, the table top will drop only a very short distance before it once more finds solid support on the planks 19 at the upper end of the base frame. In practice, the clearance between the planks 19 and the underside of the table top boards 22 need be no more than two or three millimeters. The possibility of failure of any of the pins 25, 27 is quite remote since these can easily be selected to be of a size and strength sufficient to support any practical load with a high safety factor. Furthermore these pins provide an abutment type support for the stringers 23, and are loaded in shear to which they are highly resistant. In no sense is there any reliance on gripping or frictional forces to support the table top 3.

Figure 5:
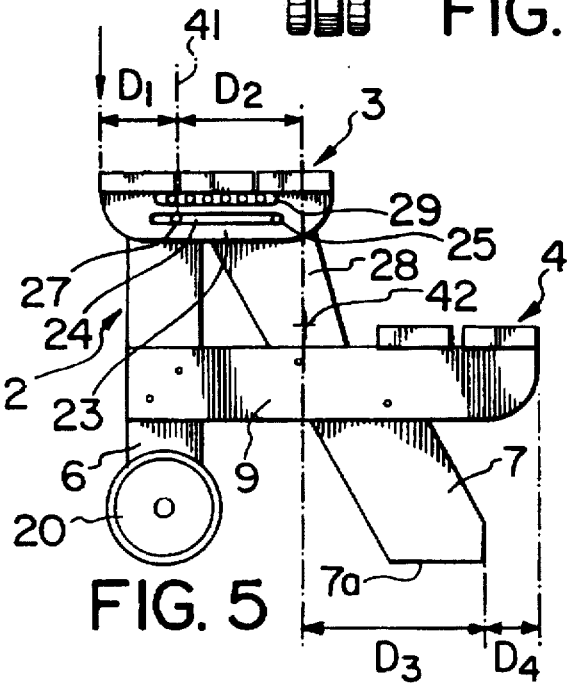
FIG. 5 is an end elevational view of the article as seen from the right hand side of FIG. 4.
Figure 6:
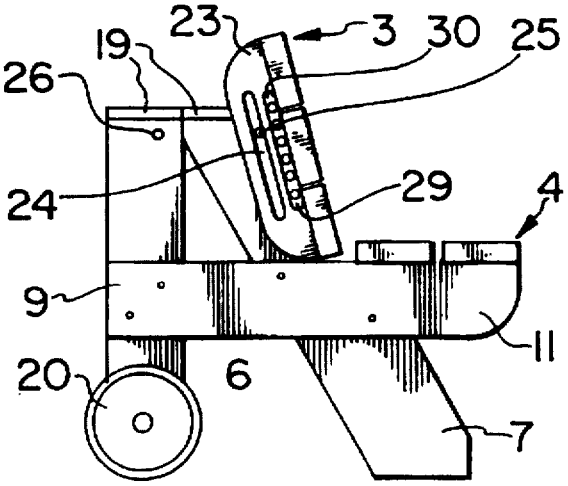
FIG. 6 is a view corresponding to FIG. 5 but showing the furniture article in an altered configuration.

From the foregoing description it will be appreciated that when the retaining pins are withdrawn, the table top 3 can be moved transversely to the rear (this movement being accommodated by the slots 24) and can then be pivoted and moved downwardly to the position shown in FIGS. 2 and 6 where the table top assumes an upwardly and rearwardly inclined attitude and provides a backrest in relation to the seat 4. In this backrest position the table top 3 is supported against the upper rear edge 28 of the rear legs 7, this edge 28 being angulated as seen in FIG. 5 to be somewhat more upright than the direction of orientation of the leg 7.

When it is required for the table top to be held at a slight inclination, the retaining pins 27 are withdrawn, the table top 3 pivoted slightly upwardly at its front end around the pins 25, and after reinsertion of the retaining pins 27, the table top is released so that the lower surfaces of the stringers 23 come to rest on the retaining pins 27. Minor variations in the inclination can be effected by providing on the retaining pins 27 an eccentric polygonal cam configuration (not shown) having a number of facets at different spacings from the axis of the pin, in use these facets being selectively oriented to support the lower surfaces of the stringers 23.

Figure 7:
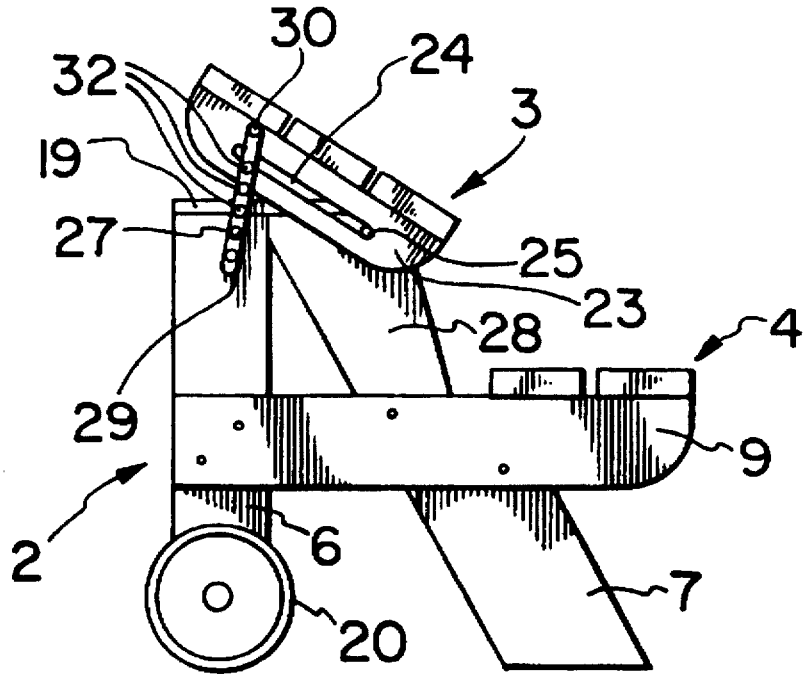
FIG. 7 is a view corresponding to FIG. 5 showing the article in yet another configuration.
Figure 8:
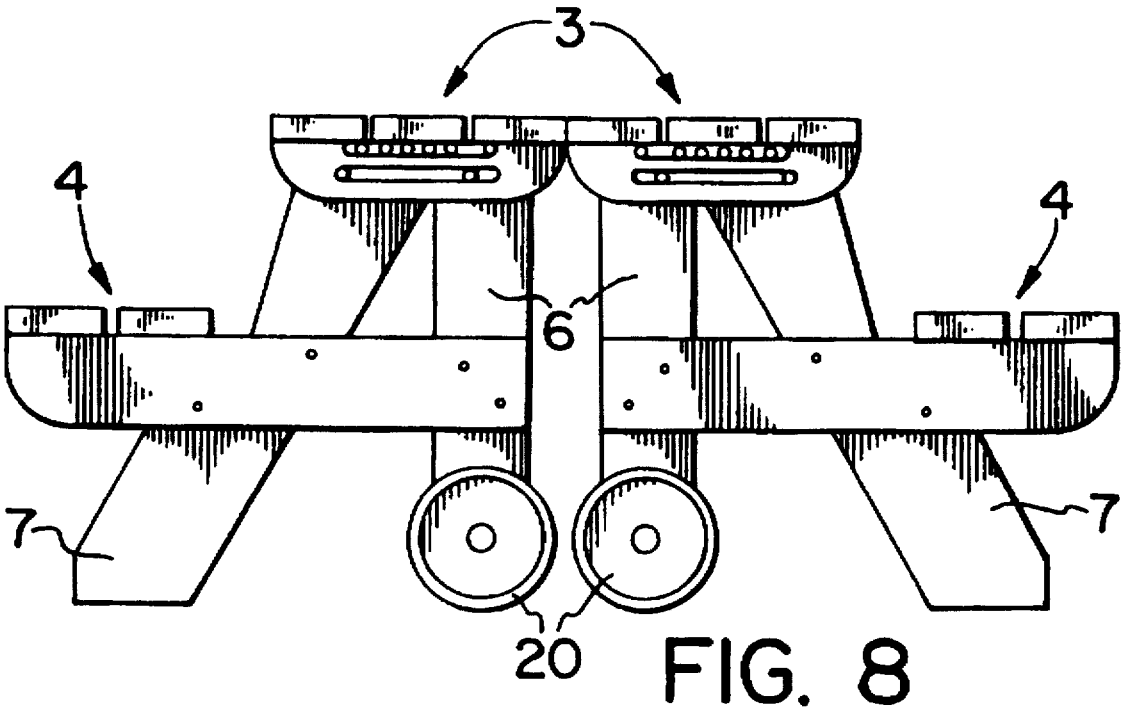
FIG. 8 is an end elevation showing two such convertible furniture articles juxtaposed to provide a picnic table.

Additional or alternative means can be provided for adjusting the inclination of the table top 3, as shown in FIG. 5 this being in the form of an elongate link or strut 29 lying against the underside of the planks 23 on the outboard side of each stringer 23 and pivoted to the latter by a pin 30. Each of the links 29 has a series of longitudinally spaced holes 32 of a size to accommodate passage of the retaining pin 27. Therefore when the retaining pin is withdrawn and the table top pivoted upwardly at its front about the axis of the pins 25, each link 29 can be swung downwardly, and a selected one of its holes brought into register with the socket 26 whereupon the retaining pin can be inserted through that hole into the socket, and the link 29 will form a strut to support the table top at the desired inclination as illustrated in FIG. 7. When not in use the links 29 are stowed against the underside of the table top planks 22 and retained thereby suitable means, e.g. springs (not shown).

FIG. 9 shows the interconnection of the pivot pin 25 to the base frame 5. The pivot pin is received in a bore 34 in the base frame and is secured by a washer 35 and a wing nut 36, there being a further washer 37 between the head of the pivot pin and the outer side of the stringer 23, the pivot pin passing with clearance through the slot 24.

Figure 10:
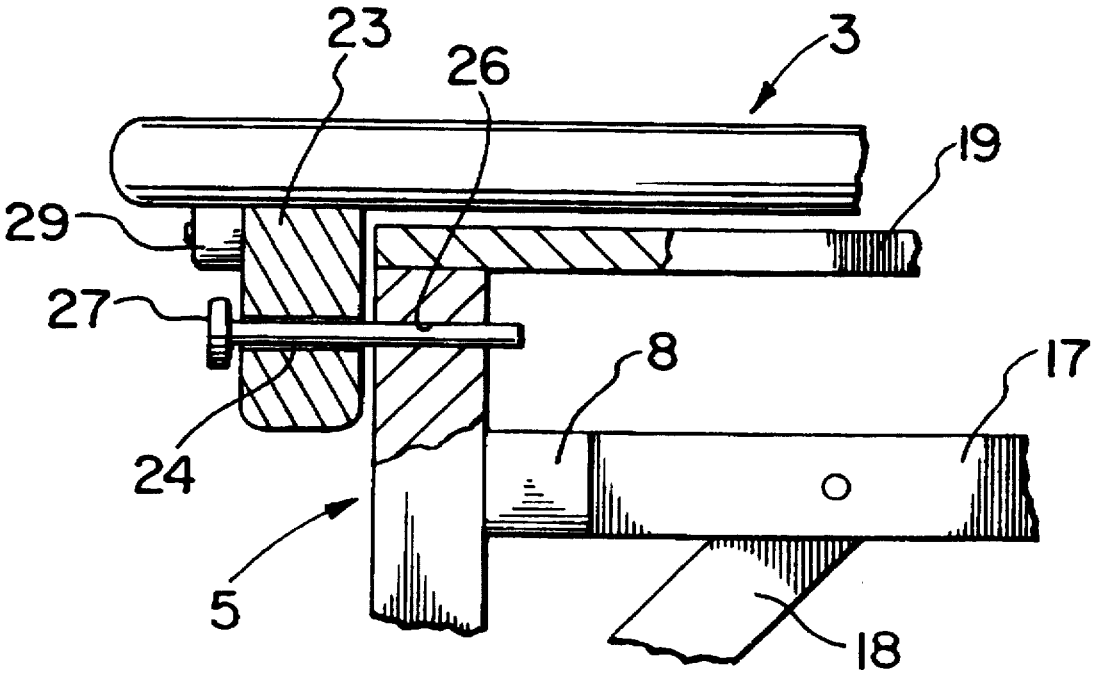
FIG. 10 is a view corresponding to FIG. 9 showing a modification.

Similarly, as seen in FIG. 10, the retaining pin 27 passes with clearance through the slot 24 to be received in the socket 26 formed by a bore in the front leg 6.

From the foregoing it will be appreciated that the described furniture article is readily convertible from the table configuration as shown in FIG. 1 to the seating configuration as shown in FIG. 2. What is particularly advantageous about the convertible furniture article of the present invention is its stability when used as a platform or staging in the configuration seen in FIGS. 1 and in 3 to 5. In this configuration the upper surface of the table top 30 will be at a height of some 70 to 75 centimeters above the ground support surface, and may readily be accessed by a user employing the seat 4 as a step. With reference to FIG. 5 it will be seen that the retaining pins 27 and pivot pins 25 between them provide a secure attachment and support for the table top upon the base frame 2, this support extending over the major part of the width of the table top as measured in the front to back direction.

Furthermore, the furniture article provides a secure and stable support for a user standing on the table top. Thus even if the weight of the user is concentrated on the forwardmost edge of the table top as indicated by the arrow 40 in FIG. 5, the article will remain stable so long as the distance of the arrow 40 forwardly of the vertical plane 41 of the forwardmost point of contact between the support frame 2 and the ground, i.e. the location where the wheels 20 contact the ground, times the weight of the user, is less than the spacing between the plane 41 and the center of gravity 42 times the weight of the furniture article 1. In other words the furniture article will remain stable so long as the following relationship holds true:

$$L \times D_1 > W \times D_2$$

where:

L is the load produced by the weight of the user,

W is the weight of the furniture article, $D_1$ is the spacing between the arrow 40 and the plane 41, and $D_2$ is the spacing between the center of gravity 42 and the plane 41.

In comparing FIGS. 1 and 5 it will be seen that in the former, the critical plane will coincide with the front of the feet 6a formed by the lower ends of the front legs 6 whereas in FIG. 5, with the wheels centrally mounted on the front legs 6, the plane 41 is at an intermediate location about midway between the front and rear of the feet 6a of front legs 6. Thus in order to increase the stability of the furniture article it is preferable to ensure that the wheels 20 contact the ground surface more or less directly below the front edge of the table top 3. For this purpose, rather than the wheels being mounted centrally in the front legs 6, they may be mounted with their axis in the regions of the forward edge of the front legs (not shown). Alternatively, the front legs 6 may be angled forwardly downwardly to achieve the same effect. In the embodiment shown in FIG. 5 the ratio $D_1$: $D_2$ is in excess of 5 so that the furniture article can stably support a load at the location of the arrow 40 of at least 5 times the weight of the furniture article.

Similarly, as shown in FIG. 5, the spacing $D_3$ of the center of gravity 42 forwardly of the vertical plane defined by the rear end of the feet 7a is at least 5 times greater than the spacing $D_4$ from this plane of the rear most part of the seat 4a, so that this location of the seat can support a load in excess of 5 times the weight of the bench without tipping. If desired, the seat could be shortened or the rear feet 7a extended so that there is no overhang of the seat.

Because of the solid structure of the frame 2 and the wide based support its provide for both the seat 4 and the table top 3, the furniture article when in the configuration shown in FIGS. 1 or 5 is extremely stable and provides a secure working platform for the user.

To ensure adequate stability for the article when used as a platform, the base frame (2) must support the table top (3) or at least half of its transverse (i.e. front to back) width. Thus, with reference to FIG. 5, the horizontal spacing between the pivot pins (25) and the retaining pins (27) must be at least 50%, preferably 75%, and most preferably from 80% to 90% of the width of the table top (3). This combined with the wide base provided between the front and rear legs (6, 7) ensures a very stable support for the furniture article.

An alternative means (not shown) for adjusting the inclination of the table top (3) as discussed in relation to FIG. 7 may be provided by locating elongate support struts similar to the struts (29) on the inboard side of each stringer (23). This strut could be of metal or strong plastic of a thickness about three millimeters, a width of about 2.5 centimeters and a length of about 30 centimeters and pivoted on a bolt the threaded end of which extends to the outboard side of the stringer (23) to be engaged by a wing nut by means of which the link can be pressed against the inboard side of the stringer (23) to provide a frictional force which will retain the link, when not in use, in a retracted position where it is hidden by the stringer (23), but from which it can nonetheless readily be swung downwardly when it is required to support the table top at an inclination. This repositioning of the strut from the outboard to the inboard side of the stringer (23) also has the advantage that it is now about 6 cm closer to the sub-frame (5) and can thus more strongly resist lateral movement of the table top (3).

Another means of preventing or substantially eliminating lateral movement of the table top (2) when it is supported in an inclined condition is to provide a blocking means (not shown) which can be selectively engaged to prevent movement of the slot (24) relative to the pivot pin (25). The blocking means could be in the form of a detent (not shown) mounted on the stringer (23) and capable of being inserted into the slot (24) near the rearward end thereof when it is desired to block movement of the pin (25) lengthwise of the slot (24).

We claim:

1. An article of furniture comprising:

a substantially rigid base frame having four feet regularly arranged in longitudinally aligned front and rear pairs which pairs are spaced transversely from each other to provide a stable support for said article upon a horizontal surface, said front pair of feet being wheels;

said frame including longitudinally spaced sub-frames extending transversely and from top-to-bottom of said frame, said sub-frames being rigidly interconnected by vertically and transversely spaced horizontally extending frame elements and by brace means;

two of said frame elements comprising a pair of longitudinally spaced horizontal supports each rigidly attached at transversely spaced locations on said frame and having end portions projecting transversely beyond a rear side of said frame;

a horizontal seat carried on and extending between said end portions;

said article further including a table top having a length and a width, said table top being selectively movable between a horizontal position wherein said table top is supported on a top section of said frame, and a lower position wherein said table top is supported on said frame in a position extending upwardly from one longitudinal edge of said seat so as to provide a backrest, guide means interacting between said table top and said frame to accommodate such movement of the table top;

retainer means selectively operable to secure said table top in said horizontal position wherein said table top is transversely offset relative to said seat; wherein said frame carries support means that extend over a distance in the front-to-rear direction that corresponds to a major portion of the width of the table top such that in the horizontal position the table top is stably supported on said support means over a major part of the width of said table top;

said article of furniture having a center of gravity and having a weight distribution such that when said article of furniture is supported on a horizontal surface and the weight of a user is concentrated on the front of said table top, the article of furniture remains stable.

2. An article of furniture as claimed in claim 2 wherein said seat has a rear edge that projects rearwardly beyond the rear pair of feet, said weight distribution of the article being such that when said table top is in the horizontal position the article will remain stable even when the entire weight of the user is concentrated on said rear edge of the seat.

3. An article of furniture as claimed in claim 1 wherein said guide means comprises a pin and slot mechanism forming an interconnection between said table top and said frame.

4. An article of furniture as claimed in claim 1 wherein said guide means comprises at each end of said frame a longitudinally extending pivot pin received within a corresponding transversely extending slot on the underside of said table top, said pivot pins being substantially coaxial, and said table top being movable transversely relative to and pivotable about the axis of said pivot pins, said retainer means comprising retaining pins that are insertable through said slots when the table top is in horizontal position, each said retaining pin being received within a socket in said frame to inhibit horizontal or pivotal movement of the table top relative to said frame.

5. An article of furniture as claimed in claim 4 wherein the weight of said table top and any load supported thereon is transmitted to said frame solely through said pivot pins and said retaining pins.

6. An article of furniture as claimed in claim 4 wherein each said slot is provided in an elongate transverse member attached beneath said table top, each said transverse member having a lower surface that is spaced below said slot and that can be rested on the respective retaining pin to support said table top thereon at an inclination to the horizontal.

7. An article of furniture as claimed in claim 5 including means to effect support of said table top selectively in any of a plurality of inclined positions on top of said frame.

8. An article of furniture as claimed in claim 7 wherein said support effecting means comprises a pivoted link adjacent each end of said table top, each said pivoted link having a series of holes spaced therealong, said links being positionable so that selected holes therein are in register with said sockets such that the retaining pins can be engaged with said sockets through said selected holes and said links form struts to support said table top at a desired angle of inclination.

9. An article of furniture as claimed in claim 1 wherein each said sub-frame comprises a generally upright front leg, an upwardly and forwardly inclined rear leg, and transversely extending supports interconnecting said legs adjacent their upper ends and at an intermediate location in their height.

10. An article of furniture as claimed in claim 1 wherein each said sub-frame comprises a generally upright front leg, an upwardly and forwardly inclined rear leg, and transversely extending supports interconnecting said legs adjacent their upper ends and at an intermediate location in their height and wherein said longitudinally spaced horizontal supports provide said intermediate connection of the front and rear legs of the respective sub-frame.

11. An article of furniture as claimed in claim 1 wherein said seat has a handhold provided therein to facilitate grasping and lifting the rear side of the article.

12. An article of furniture as claimed in claim 1 wherein at least said table top is of wood.

13. An article of furniture as claimed in claim 1 which is fabricated substantially entirely of wood except for said wheels, said pivot pins, said retaining pins, and fastening hardware.

14. An article of furniture as claimed in claim 5 wherein said base frame has a top end that provides a secondary horizontal supporting platform spaced closely below the underside of the table top and providing a large auxiliary supporting surface that becomes operative in the event of failure of any of said pivot pins and said retaining pins.

15. An article of furniture as claimed in claim 7 wherein each said pivoted link is positioned on the inboard side of a stringer member that extends transversely on the underside of the table top.

16. An article of furniture as claimed in claim 1 wherein in said lower position the table top has a longitudinal marginal portion thereof located at a position that is below and in front of the top of said seat.

17. An article of furniture as claimed in claim 1 wherein in said lower position the table top has a longitudinal marginal portion thereof located at a position that is below and in front of the top of said seat and wherein in said lower position the table top rear edge rests upon said horizontal supports in front.

18. An article of furniture comprising:

a substantially rigid base frame having four feet regularly arranged in longitudinally aligned front and rear pairs which pairs are spaced transversely from each other to provide a stable support for said article upon a horizontal surface;

said frame including longitudinally spaced sub-frames extending transversely and from top-to-bottom of said frame, said sub-frames being rigidly interconnected by vertically and transversely spaced horizontally extending frame elements and by brace means;

two of said frame elements comprising a pair of longitudinally spaced horizontal supports each rigidly attached at transversely spaced locations on said frame and having end portions projecting transversely beyond a rear side of said frame;

a horizontal seat carried on and extending between said end portions;

a table top having a length and a width, said table top being selectively movable between a horizontal position wherein said table top is supported on a top section of said frame, and a lower position wherein said table top is supported on said frame in a position extending upwardly from one longitudinal edge of said seat so as to provide a backrest;

guide means interacting between said table top and said frame to accommodate such movement of the table top said guide means comprising at each end of said frame a longitudinally extending pivot pin received within a corresponding transversely extending slot on the underside of said table top, said pivot pins being substantially coaxial, and said table top being movable transversely relative to and pivotable about the axis of said pivot pins;

retainer means selectively operable to secure said table top in said horizontal position wherein said table top is transversely offset relative to said seat, said retainer means comprising retaining pins that are insertable through said slots when the table top is in its horizontal position, each said retaining pin being received within a socket in said frame to inhibit horizontal or pivotal movement of the table top relative to said frame;

wherein said frame carries support means that extend over a distance in the front-to-rear direction that corresponds to a major portion of the width of the table top such that in the horizontal position the table top is stably supported on said support means over a major part of the width of said table top;

said article of furniture having a center of gravity and having a weight distribution such that when said article of furniture is supported on a horizontal surface and the weight of a user is concentrated on the front of said table top, the article of furniture remains stable.

19. An article of furniture as claimed in claim 18 wherein the weight of said table top and any load supported thereon is transmitted to said frame solely through said pivot pins and said retaining pins.

20. An article of furniture as claimed in claim 19 wherein said base frame has a top end that provides a secondary horizontal supporting platform spaced closely below the underside of the table top and providing a large auxiliary supporting surface that becomes operative in the event of failure of any of said pivot pins and said retaining pins.

21. An article of furniture as claimed in claim 18 wherein said front pair of feet comprise wheels.

22. An article of furniture as claimed in claim 21 wherein said seat has a hand hold provided therein to facilitate grasping and lifting the rear side of the article such that it can be rolled on said wheels.

23. An article of furniture as claimed in claim 18 which is fabricated substantially entirely of wood except for said pivot pins, said retaining pins, and fastening hardware.

24. An article of furniture as claimed in claim 18 including means to effect support of said table top selectively in any of a plurality of inclined positions on top of said frame.

* * * * *

UNITED STATES PATENT AND TRADEMARK OFFICE

CERTIFICATE OF CORRECTION

PATENT NO : 5,704,683

DATED : January 6, 1998

INVENTOR(S): Robert James COOPER; Laszlo SZANTOR

It is certified that error appears in the above-identified patent and that said Letters Patent is hereby corrected as shown below:

In column 7, line 33, please delete "claim 2" and insert in lieu thereof --claim 1--.

Signed and Sealed this

Twenty-sixth Day of May, 1998

Bruce Lehman

*Attest:*

BRUCE LEHMAN

*Attesting Officer*

*Commissioner of Patents and Trademarks*